US009266168B2

(12) United States Patent
Li

(10) Patent No.: US 9,266,168 B2
(45) Date of Patent: Feb. 23, 2016

(54) INJECTION HEAD STRUCTURE OF A DIE CASTING MACHINE

(71) Applicant: Huilong Li, Taichung (TW)

(72) Inventor: Huilong Li, Taichung (TW)

( * ) Notice: Subject to any disclaimer, the term of this patent is extended or adjusted under 35 U.S.C. 154(b) by 121 days.

(21) Appl. No.: 13/962,973

(22) Filed: Aug. 9, 2013

(65) Prior Publication Data

US 2015/0041096 A1 Feb. 12, 2015

(30) Foreign Application Priority Data

May 6, 2013 (TW) ..... 102116005 A

(51) Int. Cl.
*B22D 17/20* (2006.01)

(52) U.S. Cl.
CPC ..... *B22D 17/2023* (2013.01); *B22D 17/203* (2013.01)

(58) Field of Classification Search
CPC ..... B22D 17/02; B22D 17/04; B22D 17/203
USPC ..... 164/113, 312, 316–318
See application file for complete search history.

(56) References Cited

U.S. PATENT DOCUMENTS 3,777,943 A * 12/1973 Spalding et al. ..... 222/385
6,062,294 A * 5/2000 Yukisawa et al. ..... 164/113
6,830,094 B2 * 12/2004 Fink ..... 164/113

OTHER PUBLICATIONS

The definition of a plunger, http://dictionary.reference.com/browse/plunger, 2015.*

* cited by examiner

*Primary Examiner* — Kevin E Yoon
(74) *Attorney, Agent, or Firm* — Alan D. Kamrath; Kamrath IP Lawfirm, P.A.

(57) ABSTRACT

An injection head structure of a die casting machine contains: a base including a first inlet and a plunger rod. The base also includes a through hole, a head block having an outlet, and a neck having a guiding hole. The plunger rod is mounted in the through hole and includes a receiving groove, a second inlet, and a feeding orifice. The through hole of the base has an inner conical face formed around an inner wall thereof; the plunger rod includes an outer conical face arranged around an inner wall thereof, such that when the plunger rod is inserted into the through hole of the base, the inner conical face of the base contacts with the outer conical face of the plunger rod so that the base engages with the plunger rod.

9 Claims, 10 Drawing Sheets

INJECTION HEAD STRUCTURE OF A DIE CASTING MACHINE

FIELD OF THE INVENTION

The present invention relates to an injection head structure of a die casting machine.

BACKGROUND OF THE INVENTION

With reference to FIGS. 7-9, a conventional injection head structure of a die casting machine contains a base 40 with a third inlet 401, a sleeve 50, and a nozzle tube (not shown).

The base 40 also includes a through hole 402 defined at a central portion thereof, a head block 41 extending outwardly from the outer wall thereof opposite to the first inlet 411 and having an outlet 411 formed in the head block 41, and a neck 42 connected with the head block 41 and the base 40 and having a guiding hole 421 defined in the neck 42 and communicating with the through hole 402 and the outlet 411, two opposite fixing extensions 43 extending outwardly from a top end thereof so as to fix the base 40 at a predetermined position of a die casting machine (not shown).

The sleeve 50 is mounted in the through hole 402 of the base 40 and includes a receiving groove 51 defined at a center thereof and a fourth inlet 52 formed on an outer wall thereof and corresponding to and communicating with the third inlet 52 of the base 40, and a feeding orifice 53 arranged on a bottom end of the outer wall thereof and communicating with the guiding hole 421.

The nozzle tube (not shown) is fixed in the outlet 411 of the base 40.

It is to be noted that an outer diameter of the sleeve 50 and an inner diameter of the through hole 402 of the base 40 are worked at higher precision so as to obtain accurate perpendicularity and roundness, thus connecting the plunger and the base together accurately.

In other words, the through hole 402 of the base 40 is bored and is expended at 850° C., thereafter the plunger 50 is put into the through hole 402 of the base 40 and is cooled over 24 hours so that the plunger 50 is connected with the base 40 tightly.

But such a conventional injection head structure has the following advantages:

1. The sleeve 50 and the base 40 are worked at high-temperature heat treatment, thus having high working cost. The through hole 402 of the base 40 is bored at 850° C., an unsafe working process occurs accordingly.

2. The sleeve 50 cannot be removed from the base 40, so the injection head is replaced at high cost. Furthermore, the through hole 402 of the base 40 deforms easily in heating and cooling process, a gap B therefore forms between the outer diameter of the sleeve 50 and the inner diameter of the through hole 402 as shown in FIG. 8. When the injection head is soaked in a metal fluid tank 60 at high temperature, and a hydraulic cylinder 70 pushes metal fluid in the receiving groove 51 so that the metal fluid is injected out of the outlet 411 of the base 40 from the feeding orifice 53 via the guiding hole 421, hence the metal fluid leaks from the gap B and cooled to form wastes C (as illustrated in FIGS. 9 and 10), such that the sleeve 50 is connected with the base 40 by ways of the wastes C. The sleeve 50 cannot be removed from the through hole 402 of the base 40, so the injection head has to be replaced completely after a period of using time.

3. The sleeve 50 is made of SKD61 steel, so when it is placed in the through hole 402 of the base 40, decarbonization generates between the through hole 402 and an inner wall of the receiving groove 51, and the inner wall of the receiving groove 51 of the sleeve 50 is ground, thus increasing working cost.

The present invention has arisen to mitigate and/or obviate the afore-described disadvantages.

SUMMARY OF THE INVENTION

The primary object of the present invention is to provide an injection head structure of a die casting machine which is capable of overcoming the shortcomings of the conventional injection head structure of the die casting machine.

To obtain the above objectives, an injection head structure of a die casting machine contains a base including a first inlet defined one an outer wall thereof and a sleeve, and a nozzle tube.

The base also includes a through hole defined at a central portion thereof, a head block extending outwardly from the outer wall thereof opposite to the first inlet and having an outlet formed in the head block, and a neck connected with the head block and the base and having a guiding hole defined in the neck and communicating with the through hole and the outlet.

The sleeve is mounted in the through hole of the base and includes a receiving groove defined at a center thereof and a second inlet formed on an outer wall thereof and corresponding to and communicating with the first inlet of the base, and a feeding orifice arranged on a bottom end of the outer wall thereof and communicating with the guiding hole, wherein The through hole of the base has an inner conical face formed around an inner wall thereof; the sleeve includes an outer conical face arranged around an inner wall thereof, such that when the plunger rod sleeve is inserted into the through hole of the base, the inner conical face of the base contacts with the outer conical face of the sleeve so that the base engages with the sleeve.

Thereby, the through hole of the base has the inner conical face formed around the inner wall thereof, and the sleeve includes the outer conical face arranged around the inner wall thereof, so when the sleeve is inserted into the through hole of the base, the sleeve contacts with the through hole tightly. In other words, when the sleeve and the base are connected together, the outer conical face contacts with the inner conical face, so as to obtain a complete closing effect, hence the metal fluids will not leak from the sleeve and the base.

In addition, after a period of using time, the sleeve is maintained and replaced easily. For example, in operation, an injection head of the die casting machine is turned upside down, and the sleeve is removed from the through hole of the base, thus replacing the sleeve quickly.

DETAILED DESCRIPTION OF THE PREFERRED EMBODIMENTS

Figure 1:
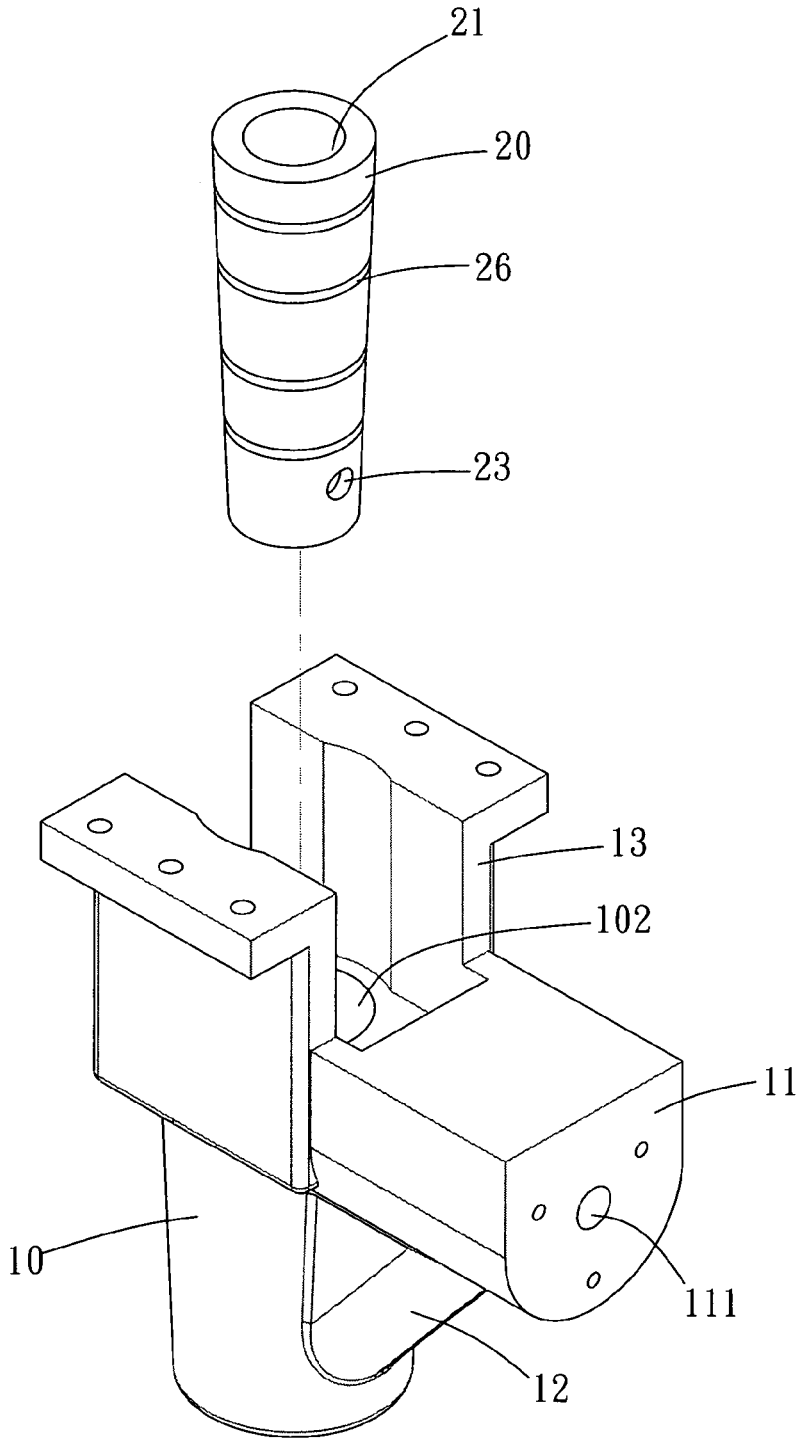
FIG. 1 is a perspective view showing the exploded components of an injection head structure of a die casting machine according to a preferred embodiment of the present invention.

FIGS. 1-5, an injection head structure of a die casting machine according to a preferred embodiment of the present invention comprises: a base 10 including a first inlet 101 defined one an outer wall thereof, a sleeve 20, and a nozzle tube (not shown).

The base 10 also includes a through hole 102 defined at a central portion thereof, a head block 11 extending outwardly from the outer wall thereof opposite to the first inlet 101 and having an outlet 111 formed in the head block 11, a neck 12 connected with the head block 11 and the base 10 and having a guiding hole 121 defined in the neck 12 and communicating with the through hole 102 and the outlet 111, and two opposite fixing extensions 13 extending outwardly from a top end thereof so as to fix the base 10 at a predetermined position of a die casting machine (not shown).

Figure 2:
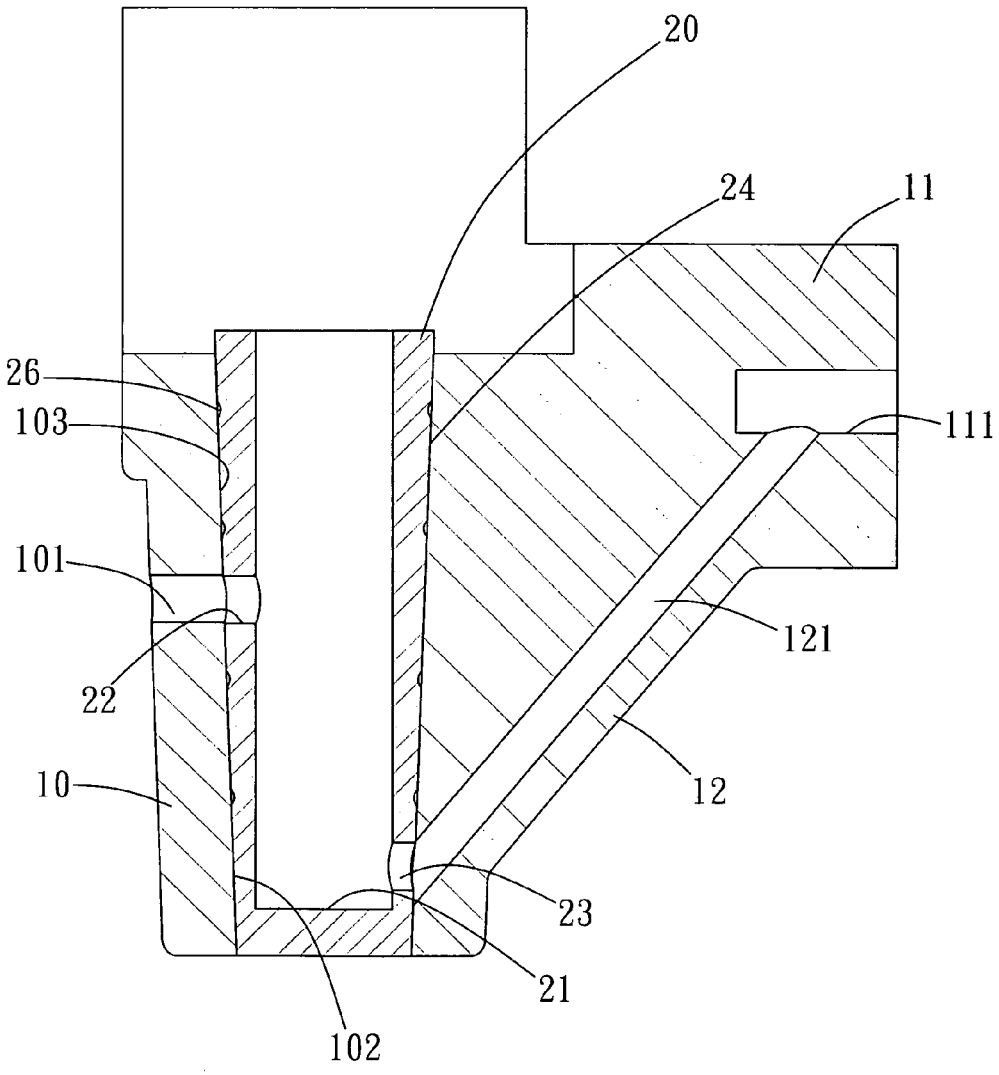
FIG. 2 is a cross sectional view showing the assembly of the injection head structure of the die casting machine according to the preferred embodiment of the present invention.

The sleeve 20 is mounted in the through hole 102 of the base 10 and includes a receiving groove 21 defined at a center thereof and a second inlet 22 formed on an outer wall thereof and corresponding to and communicating with the first inlet 101 of the base 10, and a feeding orifice 23 arranged on a bottom end of the outer wall thereof and communicating with the guiding hole 121 as illustrated in FIG. 2.

The nozzle tube (not shown) is fixed in the outlet 111 of the head block 11 of the base 10.

An improvement of the injection head structure of the present invention contains: the through hole 102 of the base 10 having an inner conical face 103 formed around an inner wall thereof; the sleeve 20 including an outer conical face 24 arranged around an inner wall thereof, such that when the sleeve 20 is inserted into the through hole 102 of the base 10, the inner conical face 103 of the base 10 contacts with the outer conical face 24 of the sleeve 20 so that the base 10 engages with the sleeve 20 as illustrated in FIG. 2.

It is to be noted that a half cone angle of the inner conical face 103 and the outer conical face 24 is respectively within 0.5 to 2 degree, and wherein a preferred range of the half cone angle of the inner conical face 103 and the outer conical face 24 is individually within 1-1.5 degree.

Figure 4:
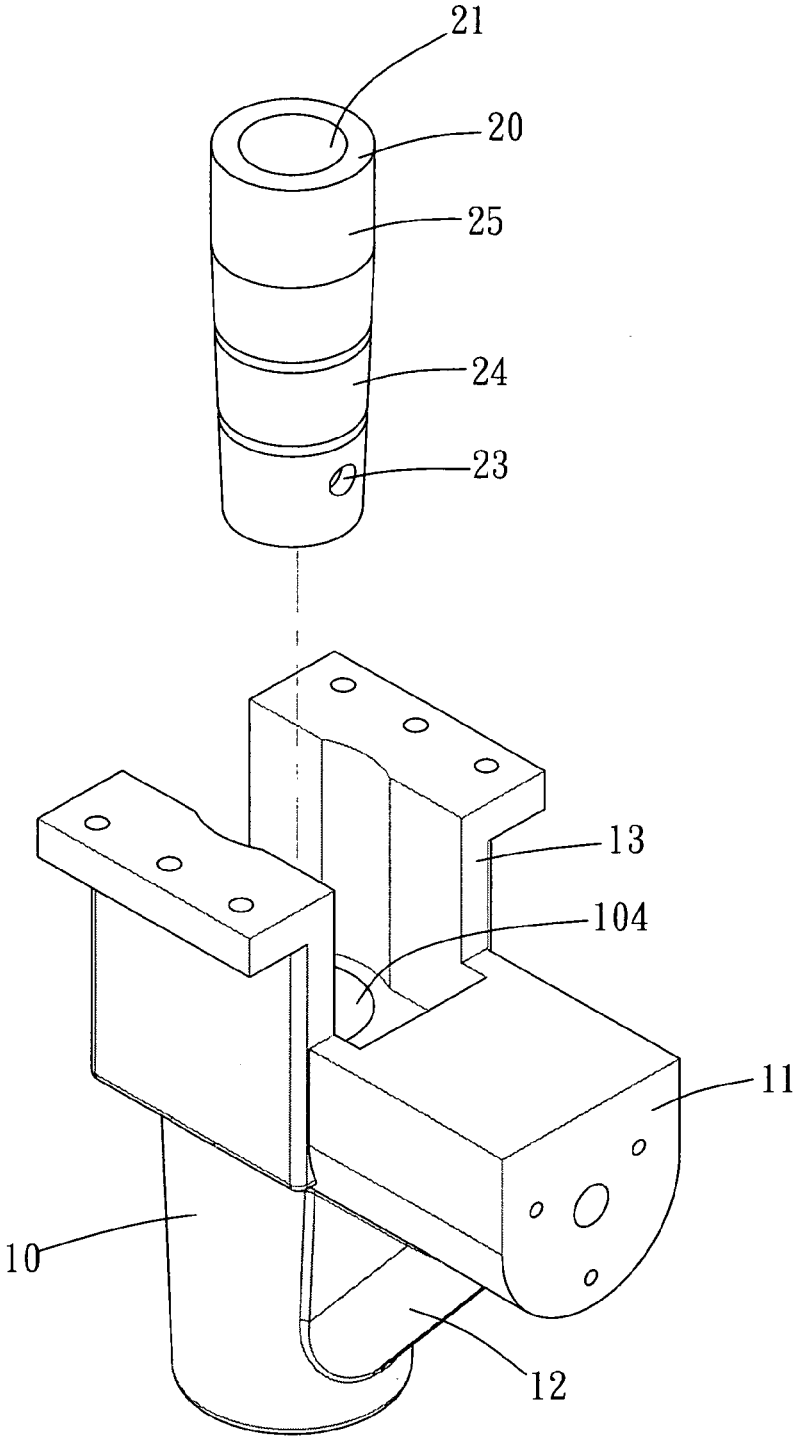
FIG. 4 is a perspective view showing the exploded components of an injection head structure of a die casting machine according to another preferred embodiment of the present invention.
Figure 5:
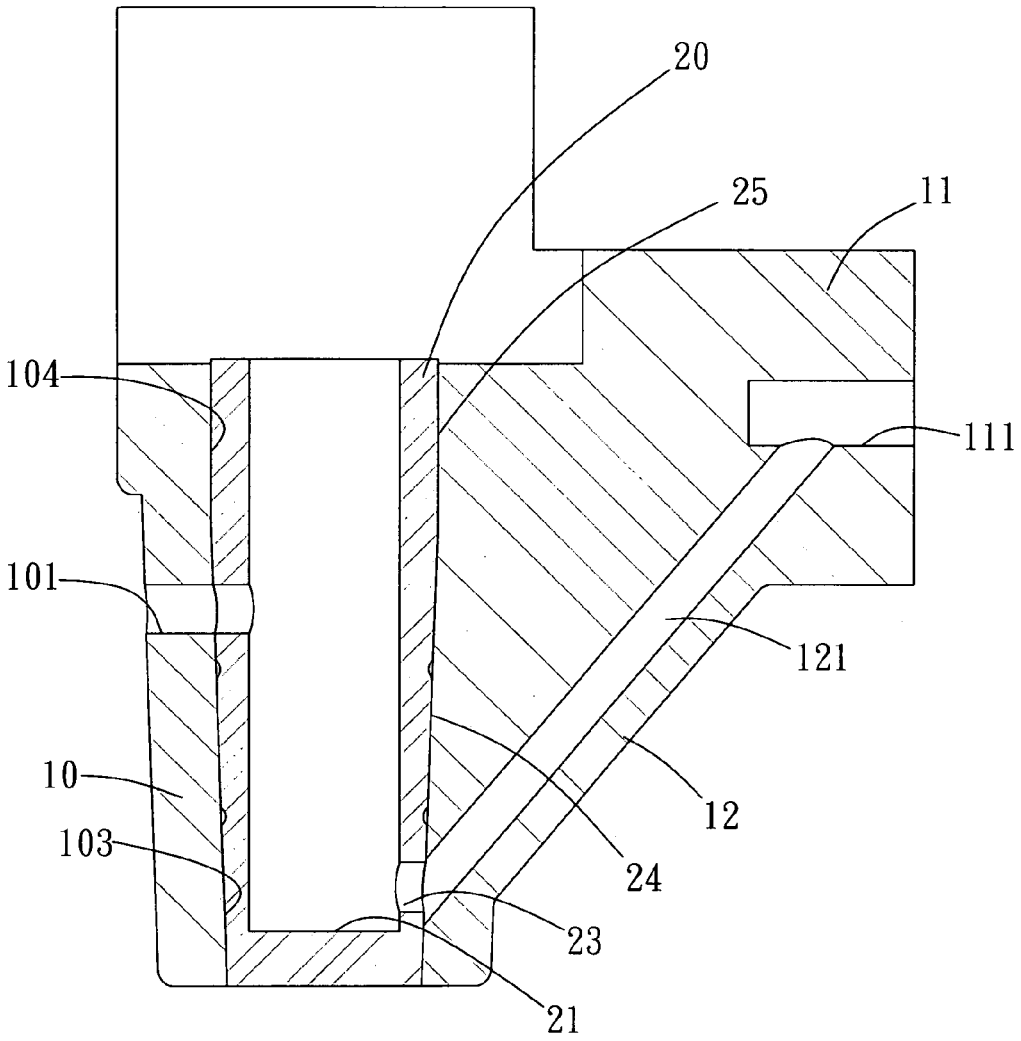
FIG. 5 is a cross sectional view showing the assembly of the injection head structure of the die casting machine according to the another preferred embodiment of the present invention.

The through hole 102 further has a first flat face 104 formed on an upper section thereof, the sleeve 20 includes a second flat face 25 defined on the outer wall thereof so as to correspond to and contact with the first flat face 104 as shown in FIGS. 4 and 5.

The sleeve 20 includes a plurality of radial slots 26 arranged around the outer wall thereof so that the sleeve 20 engages with and disengages from the through hole 102 as illustrated in FIG. 1, wherein a depth of each radial slot 26 is within 3-5 mm.

Also, the sleeve 20 further includes plural blind notches (not shown) defined on predetermined positions thereof.

Figure 8:
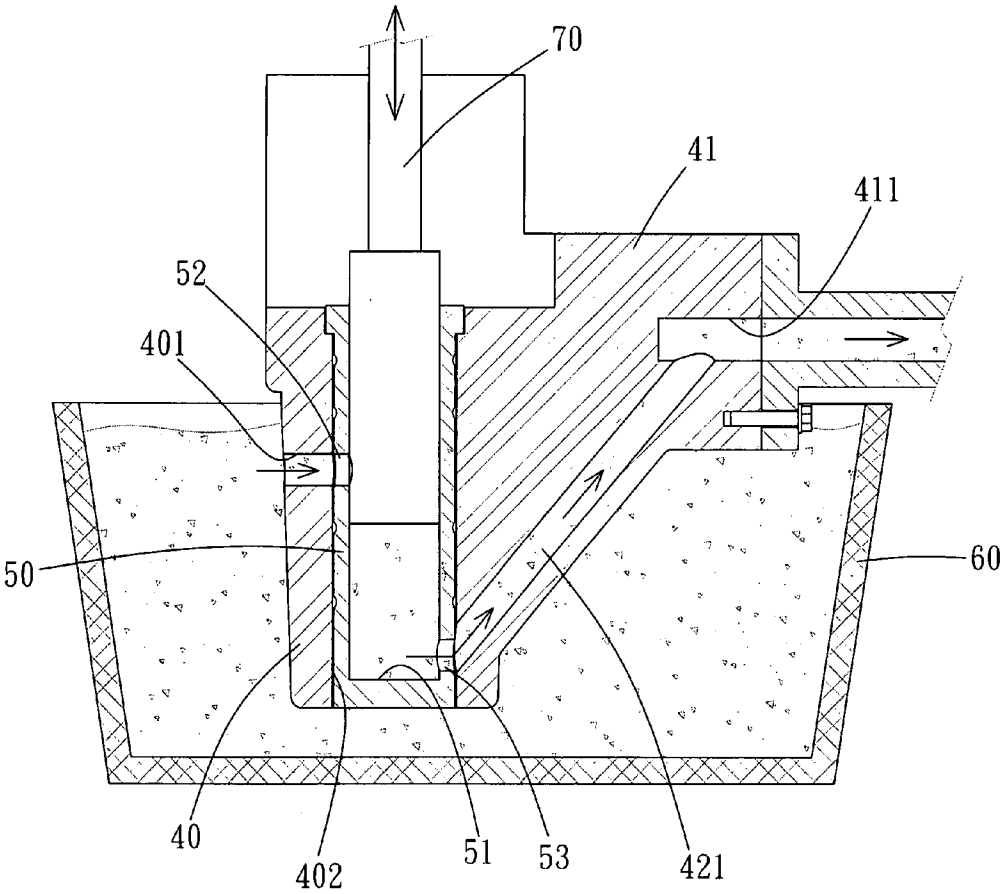
FIG. 8 PRIOR ART
FIG. 8 is a cross sectional view showing the operation of the conventional injection head structure of the die casting machine.
Figure 9:
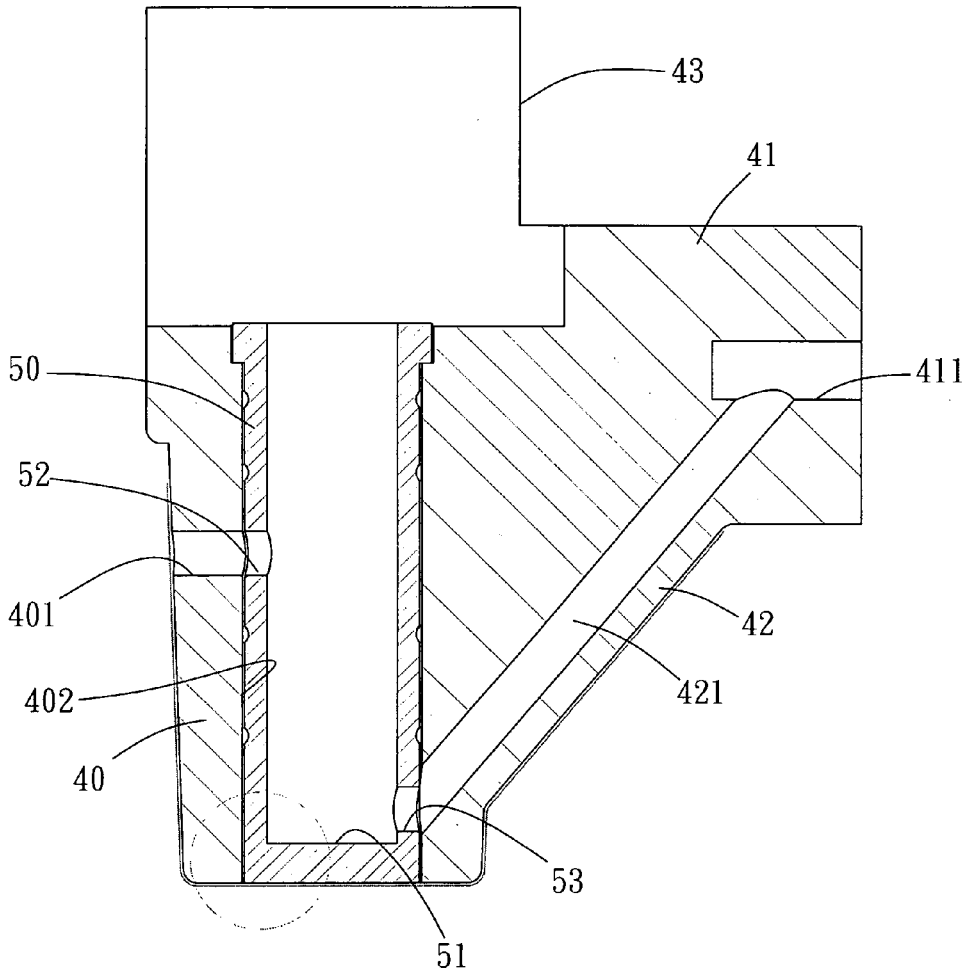
FIG. 9 PRIOR ART
FIG. 9 is a cross sectional view showing the assembly of the conventional injection head structure of the die casting machine.
Figure 10:
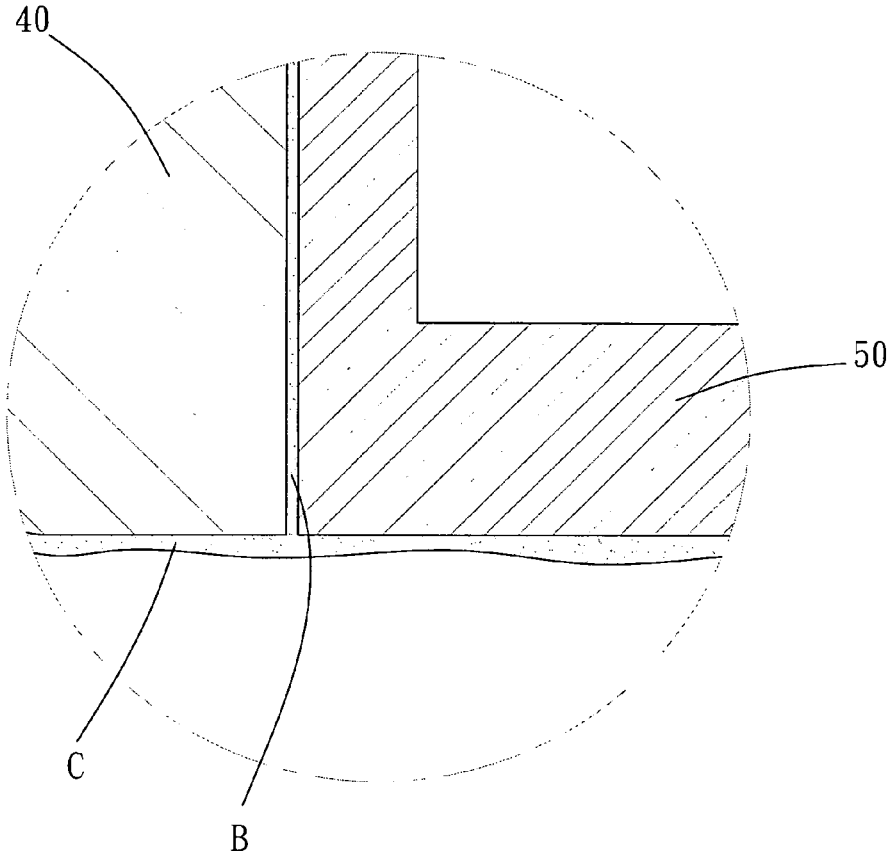
FIG. 10 PRIOR ART
FIG. 10 is a cross sectional view showing a part of the conventional injection head structure of the die casting machine.

Referring further to FIGS. 1-5, the injection head structure is mounted on the die casting machine, when the injection head is soaked in a metal fluid tank at a higher temperature so as to have a die casting operation, as shown in FIG. 8, a hydraulic cylinder in the receiving groove 21 of the sleeves 20 pushes metal fluids into the guiding hole 121 from the first inlet 101 and the second inlet 22 via the feeding orifice 23, and then the metal fluids are injected from the outlet 111.

Thereby, the through hole 102 of the base 10 has the inner conical face 103 formed around the inner wall thereof, and the sleeve 20 includes the outer conical face 24 arranged around the inner wall thereof, so when the sleeve 20 is inserted into the through hole 102 of the base 10, the sleeve 20 contacts with the through hole 102 tightly. In other words, when the sleeve 20 and the base 10 are connected together, the outer conical face 24 contacts with the inner conical face 103 as illustrated in FIG. 2, so as to obtain a complete closing effect, hence the metal fluids will not leak from the sleeve 20 and the base 10.

Figure 3:
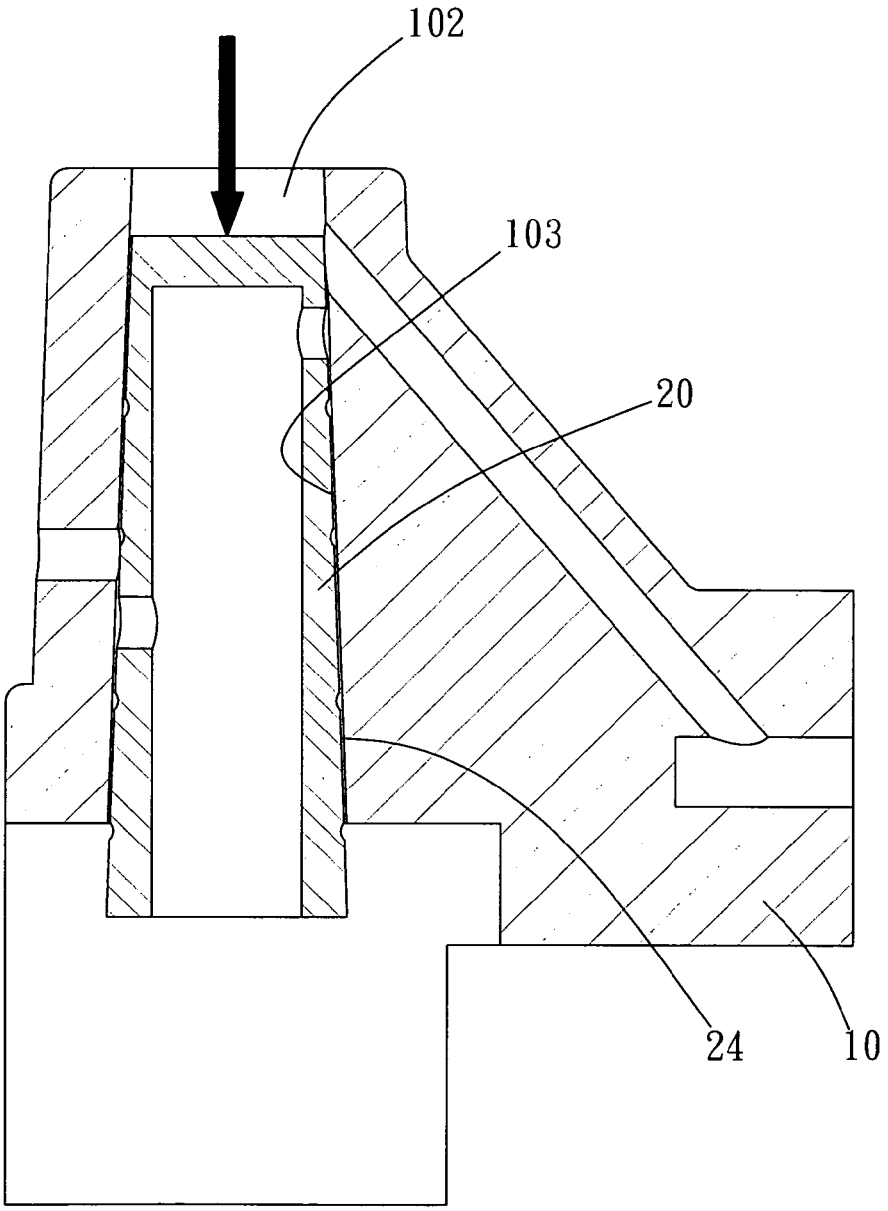
FIG. 3 is a cross sectional view showing the operation of the injection head structure of the die casting machine according to the preferred embodiment of the present invention.

In addition, after a period of using time, the sleeve 20 is maintained and replaced easily. For example, in operation, an injection head of the die casting machine is turned upside down, and the sleeve 20 is removed from the through hole 102 of the base 10 as illustrated in FIG. 3, thus replacing the sleeve 20 quickly.

Figure 6:
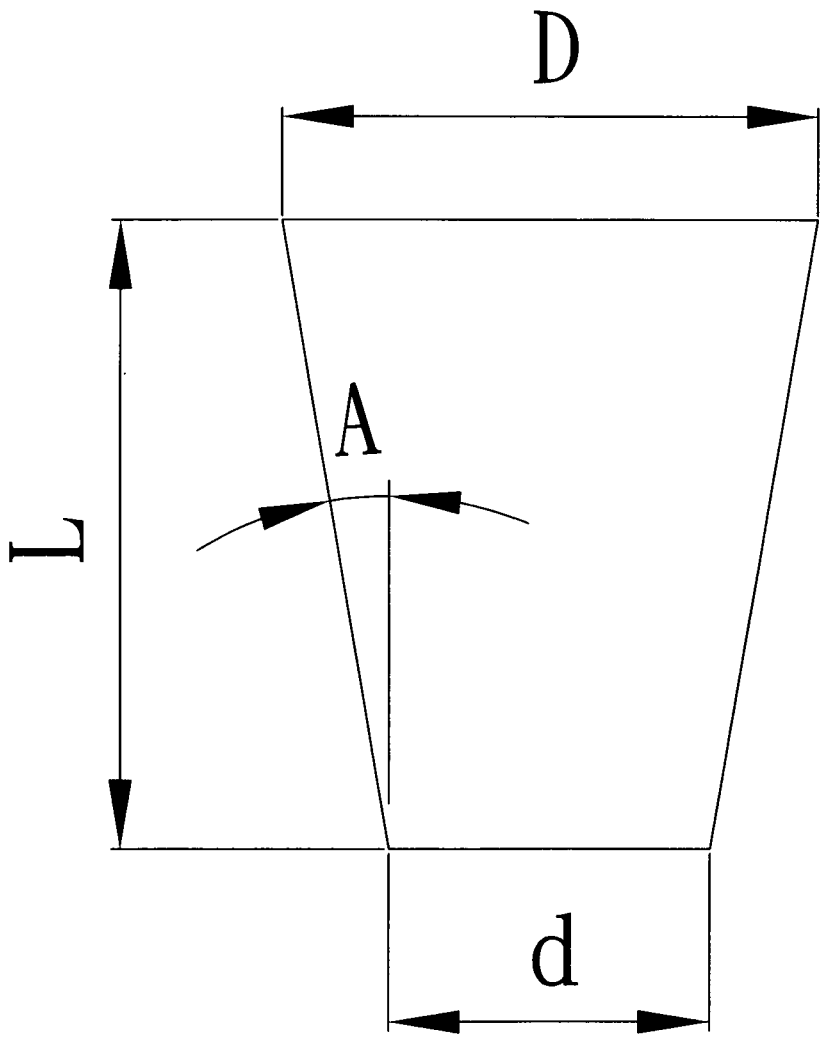
FIG. 6 is a plan view showing an outer diameter of a top end of a sleeve of the present invention, an outer diameter of a bottom end of the sleeve thereof, a length of a taper of the sleeve thereof, and a half cone angle of the sleeve thereof.
Figure 7:
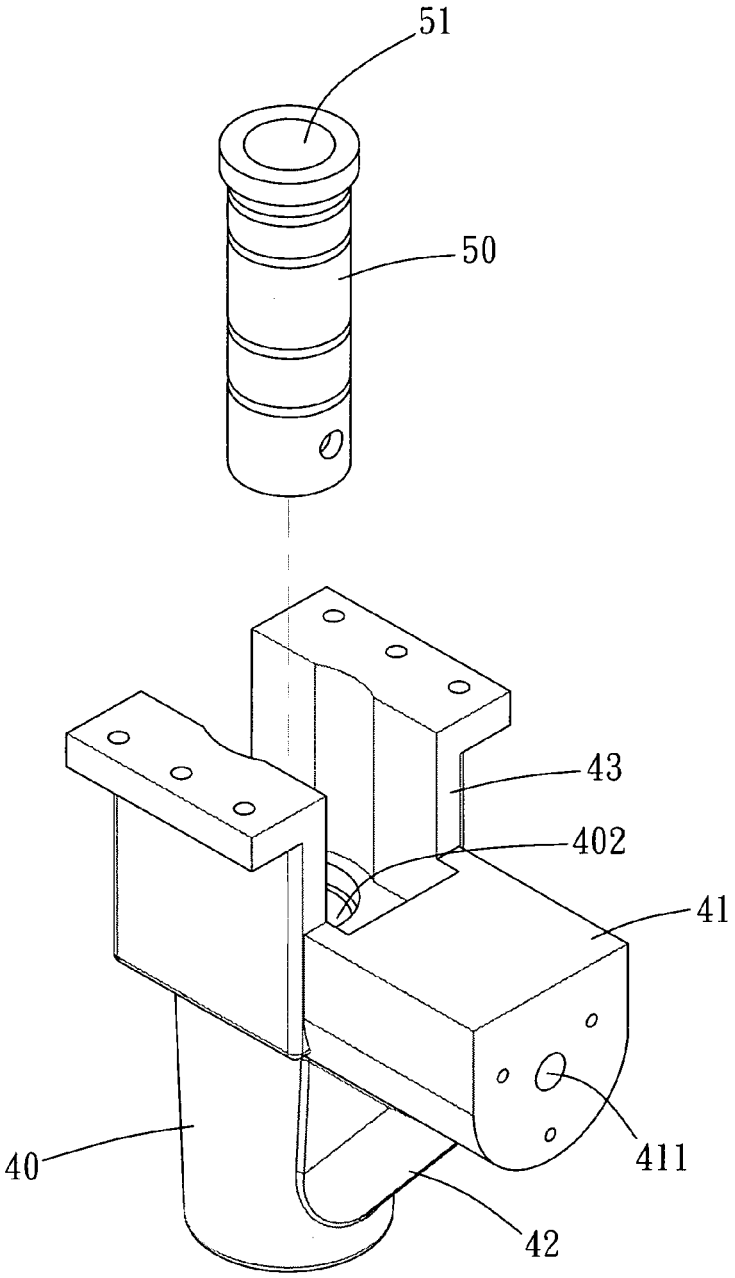
FIG. 7 PRIOR ART
FIG. 7 is a perspective view showing the exploded components of a conventional injection head structure of a die casting machine.

To ensure the injection head structure receiving 150 tons of injection pressure, plural sleeves with varying half cone angles are tested as follows. As illustrated in FIG. 6, D is an outer diameter of a top end of the sleeve, d represents an outer diameter of a bottom end of the sleeve, L denotes a length of a taper of the sleeve, and a unit of the D, d, and L is mm, and a respective one of the half cone angles is A.

Also, table 1 for showing detonation pressure and knocking test is illustrated as follows:

Table 1 which shows detonation pressure and knocking test

| Test set | A | D | d | L | detonation pressure | knocking test |
|---|---|---|---|---|---|---|
| #1 | 2.86 | 115 | 85 | 300 | N | N/A |
| #2 | 2.69 | 115 | 87 | 300 | N | N/A |
| #3 | 2.48 | 115 | 89 | 300 | N | N/A |
| #4 | 2.29 | 115 | 91 | 300 | N | N/A |
| #5 | 2.12 | 115 | 93 | 300 | Y | being knocked outward easily |
| #6 | 1.89 | 115 | 95 | 300 | Y | being knocked outward easily |
| #7 | 1.72 | 115 | 97 | 300 | Y | being knocked outward easily |
| #8 | 1.53 | 115 | 99 | 300 | Y | being knocked outward easily |
| #9 | 1.32 | 115 | 101 | 300 | Y | being knocked outward easily |
| #10 | 1.15 | 115 | 103 | 300 | Y | being knocked outward easily |
| #11 | 0.96 | 115 | 105 | 300 | Y | being knocked outward easily |
| #12 | 0.74 | 115 | 107 | 300 | Y | being knocked outward easily |
| #13 | 0.57 | 115 | 109 | 300 | Y | being knocked outward difficultly |
| #14 | 0.38 | 115 | 111 | 300 | Y | cannot be knocked outward |
| #15 | 0.19 | 115 | 113 | 300 | Y | cannot be knocked outward |

The test sets #1 to #4 cannot pass the detonation pressure test, so a subsequent knocking test is not be processed, i.e., when the half cone angles A are large, the test sets #1 to #4 cannot pass the detonation pressure test.

Moreover, although test sets #14 to #15 pass the detonation pressure test, their half cone angles A are small, the sleeves 20 cannot be knocked outward.

It is to be noted that not only the test sets #5 to #13 can pass the detonation pressure test, but also the sleeve 20 can be knocked outward during the knocking test.

From experimental data of the table 1, when the half cone angles A of the outer conical face 24 of the plunger rod sleeve 20 are within 0.5 to 2 degrees, not only the detonation pressure test at 150 tons of injection pressure passes, but also the sleeves 20 is knocked outward easily. Preferably, when the half cone angles A of the outer conical face 24 of the sleeve 20 are within 0.5 to 2 degrees, such as test sets #8 to #11, the sleeve 20 is knocked outward. It is to be noted that the through hole 102 has the first flat face 104 formed on the upper section thereof, and the sleeve 20 includes the second flat face 25 defined on the outer wall thereof so as to correspond to and contact with the first flat face 104 tightly as shown in FIGS. 4 and 5. In addition, the through hole 102 can have inner conical face 103 formed on a lower section of the inner wall thereof, and the sleeve 20 can include the outer conical face 24 arranged around a lower section of the inner wall thereof so as to obtain tight closing effect.

Thereby, the injection head structure of the present invention has the following disadvantages:

1. The sleeve 20 contacts with the neck 12 matingly at lower temperature, thus connecting the sleeve 20 with the base 10 at lower cost and less time safely.

2. The sleeve 20 contacts with the neck 12 matingly so as to prevent the metal fluids from leakage. Likewise, the plunger 20 is removed from the through hole 102 of the base 10 so as to be replaced easily.

3. The sleeve 20 connects with the base 10 at lower temperature and cannot generate decarbonization, so the receiving groove 21 of the sleeves 20 does not deform at high-temperature heat treatment and is ground in a roundness grinding process, thus decreasing assembly time and cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An injection head structure of a die casting machine comprising: a base including a first inlet defined on an outer wall thereof and a sleeve;

the base also including a through hole defined at a central portion thereof, a head block extending outwardly from the outer wall thereof opposite to the first inlet and having an outlet formed in the head block, and a neck connected with the head block and the base and having a guiding hole defined in the neck and communicating with the through hole and the outlet;

the sleeve mounted in the through hole of the base and including a receiving groove defined at a center thereof and a second inlet formed on an outer wall thereof and corresponding to and communicating with the first inlet of the base, and a feeding orifice arranged on a bottom end of the outer wall thereof and communicating with the guiding hole, wherein the through hole of the base has an inner conical face formed around an inner wall thereof; the sleeve includes an outer conical face arranged around the inner wall thereof, such that when the sleeve is inserted into the through hole of the base, the inner conical face of the base contacts with the outer conical face of the sleeve so that the base engages with the sleeve.

2. The injection head structure of the die casting machine as claimed in claim 1, wherein a half cone angle of the inner conical face and the outer conical face is respectively within degree.

3. The injection head structure of the die casting machine as claimed in claim 2, wherein the half cone angle of the inner conical face and the outer conical face is individually within 1-1.5 degree.

4. The injection head structure of the die casting machine as claimed in claim 1, wherein the through hole further has a first flat face formed on an upper section thereof, the sleeve includes a second flat face defined on the outer wall thereof so as to correspond to and contact with the first flat face.

5. The injection head structure of the die casting machine as claimed in claim 1, wherein the sleeve includes a plurality of radial slots arranged around the outer wall thereof.

6. The injection head structure of the die casting machine as claimed in claim 5, wherein a depth of each radial slot is within 3-5 mm.

7. The injection head structure of the die casting machine as claimed in claim 1, wherein the sleeve further includes plural blind notches defined on predetermined positions thereof.

8. The injection head structure of the die casting machine as claimed in claim 1 further comprising a nozzle tube fixed in the outlet of the head block of the base.

9. The injection head structure of the die casting machine as claimed in claim 1, wherein the base also includes two opposite fixing extensions extending outwardly from a top end thereof so as to fix the base at a predetermined position of a die casting machine.

* * * * *